US005588310A

United States Patent [19]

Lai

[11] Patent Number: 5,588,310

[45] Date of Patent: Dec. 31, 1996

[54] JEWELRY WITH CHANGEABLE ORNAMENTATION

[75] Inventor: Danny S. Lai, New York, N.Y.

[73] Assignee: Gramercy Enterprises (U.S.A.) Corp., New York, N.Y.

[21] Appl. No.: 516,131

[22] Filed: Aug. 18, 1995

[51] Int. Cl.[6] ..... A44C 9/00

[52] U.S. Cl. ..... 63/15; 63/29.1

[58] Field of Search ..... 63/15, 1.1, 2, 13, 63/23, 29.1, 31

[56] References Cited

U.S. PATENT DOCUMENTS

| | | | |
|---|---|---|---|
| 2,585,183 | 2/1952 | Stern | 63/15 |
| 3,959,989 | 6/1976 | Bhandia | 63/1.1 X |
| 4,854,133 | 8/1989 | Irwin | 63/15 |
| 4,970,878 | 11/1990 | Lee | 63/23 |

FOREIGN PATENT DOCUMENTS

| | | | |
|---|---|---|---|
| 2700446 | 7/1994 | France | 63/15 |
| 1079370 | 4/1960 | Germany | 63/31 |

*Primary Examiner*—Kien T. Nguyen
*Attorney, Agent, or Firm*—Kenyon & Kenyon

[57] ABSTRACT

An item of jewelry with changeable ornamentation is provided, including a body portion adapted to be worn by the user and an ornament piece mounted for display therein. The ornament piece includes a first display surface on one side thereof and a second display surface on an opposite side thereof. The ornament piece is rotatably mounted in the body portion such that it is rotatable between a first display position wherein the first display surface is displayed through an opening in the body portion and a second display position wherein the second display surface is displayed through the opening in the body portion.

6 Claims, 4 Drawing Sheets

JEWELRY WITH CHANGEABLE ORNAMENTATION

TECHNICAL FIELD OF THE INVENTION

The present invention relates generally to jewelry and, more particularly, to jewelry with changeable ornamentation.

BACKGROUND OF THE INVENTION

Items of jewelry such as rings, earrings and pendants generally comprise an outer body portion adapted to be worn by the wearer and an ornamental item such as, for example, a precious stone or other decorative article secured to the front of the body portion for display. The ornamental item is normally fixedly secured to the body portion by, for example, gluing or soldering processes and cannot be easily removed or replaced with other ornamental items. Thus, a consumer desiring jewelry with different ornamental items would have to purchase two or more separate items of jewelry, each having one of the ornamental items. An object of the present invention is to provide a single article of jewelry having two different ornamental items that can be quickly and easily interchanged when desired.

SUMMARY OF THE INVENTION

An item of jewelry with changeable ornamentation is provided, including a body portion adapted to be worn by the user and an ornament piece mounted for display therein. The ornament piece includes a first display surface on one side thereof and a second display surface on an opposite side thereof. The ornament piece is rotatably mounted in the body portion such that it is rotatable between a first display position wherein the first display surface is displayed through an opening in the body portion and a second display position wherein the second display surface is displayed through the opening.

The ornament piece includes two pins extending from opposite sides thereof defining an axis about which the ornament piece is rotatable. The body portion also includes two slots at opposite sides of the opening that are adapted to receive the pins of the ornament piece for rotating and sliding movement of the pins therein. The ornament piece also includes two locking projections extending therefrom, and the body portion includes two corresponding platforms adapted to engage the locking projections to releasably lock the ornament piece in one of the first and second display positions and thereby restrain the ornament piece from sliding or rotating movement with respect to the body portion. The locking projections or the platforms or both are resiliently deformable such that the locking projections can be forced out of engagement with the platforms to free the ornament piece for sliding or rotating movement with respect to the body portion.

DETAILED DESCRIPTION

Figure 1:
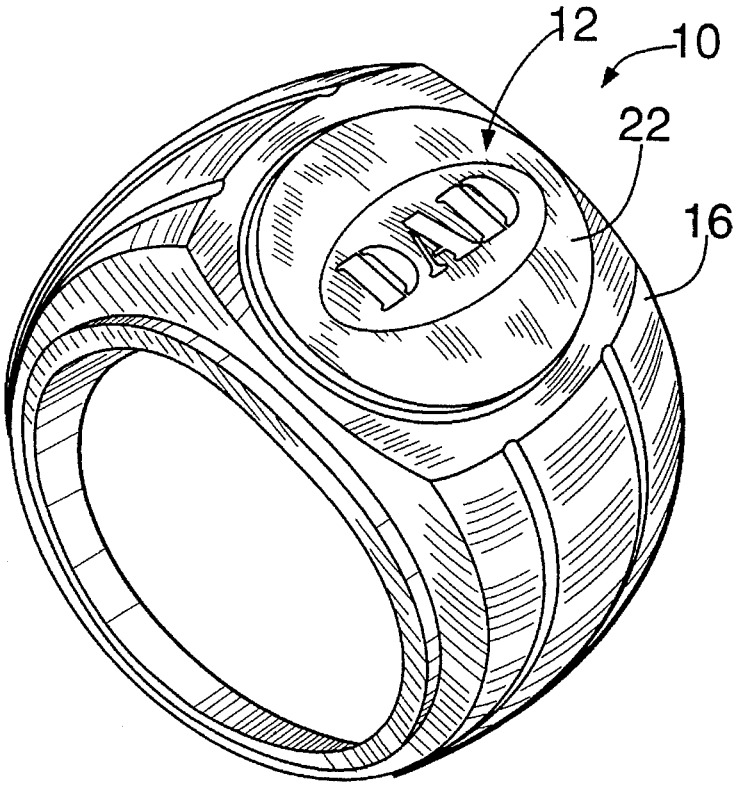
FIG. 1 is a perspective view of a ring in accordance with the present invention, including an ornament piece positioned therein to display a first display surface.
Figure 2:
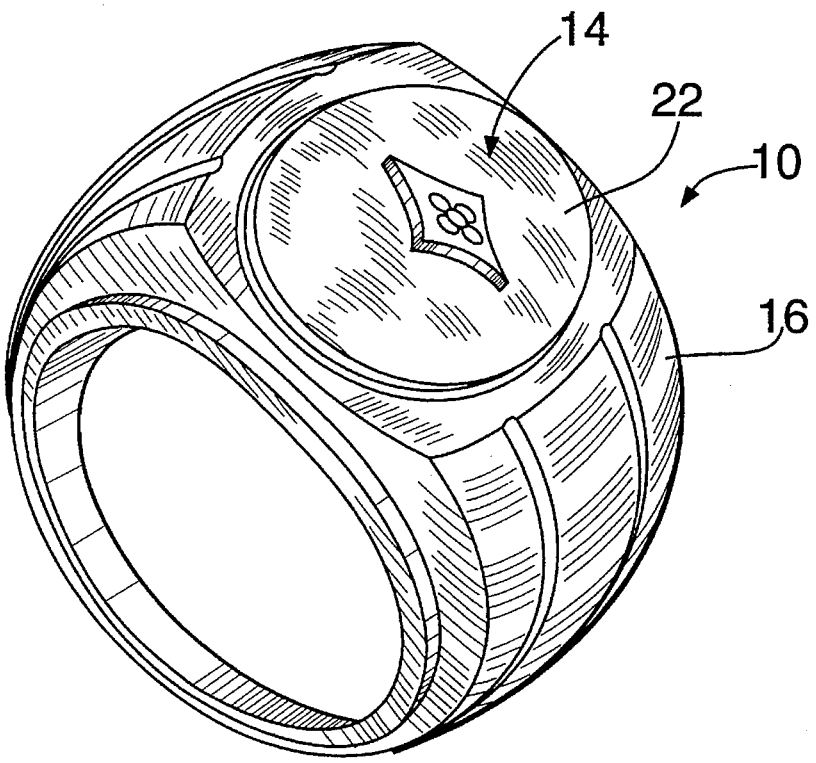
FIG. 2 is a perspective view of the FIG. 1 ring with the ornament piece positioned to display a second different display surface.

FIGS. 1 and 2 illustrate an exemplary ring 10 with changeable ornamentation in accordance with the present invention. In FIG. 1, the ornamentation comprises a first display surface 12 containing, for example, the word "DAD." In FIG. 2, the ornamentation comprises a second different display surface 14 containing, for example, a diamond-shaped emblem. In accordance with the present invention, the ornamentation can be quickly and easily interchanged by the ring wearer when desired.

Figure 3:
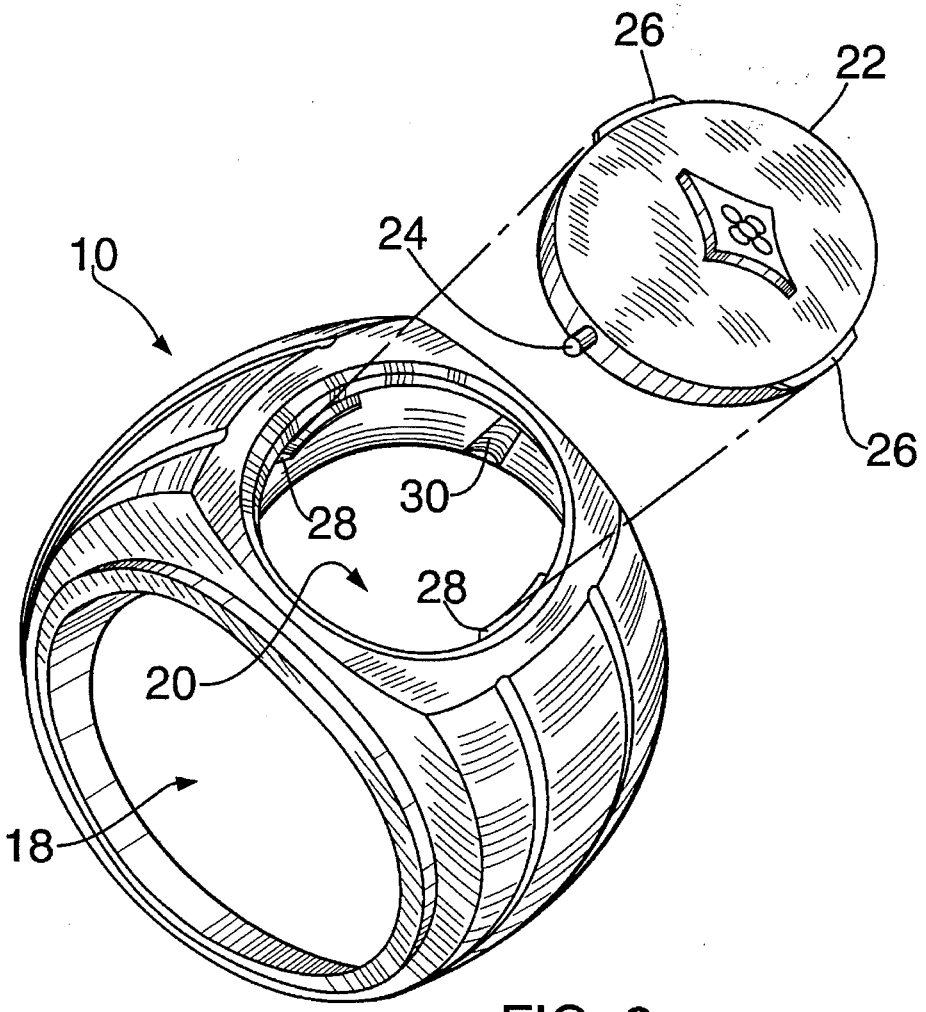
FIG. 3 is an exploded perspective view of the ring illustrating the body portion and the ornament piece of the ring.

As shown in FIG. 3, an exploded view of the ring 10, the ring 10 comprises a ring body 16 having a large throughole 18 extending between the front and rear sides of the ring for receiving a finger of the wearer. The ring body 16 also comprises a smaller opening 20 at its top surface for receiving a decorative or ornamental piece 22.

Figure 4:
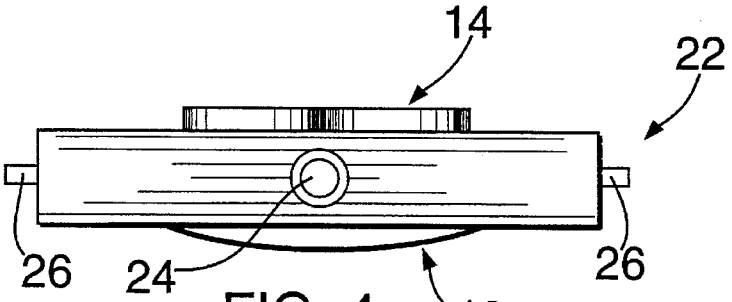
FIG. 4 is a front view of the ornament piece.
Figure 5:
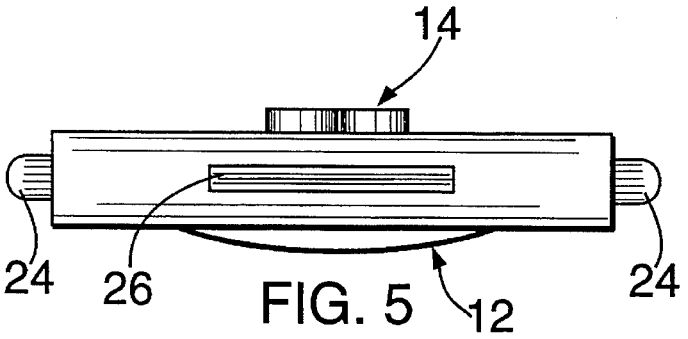
FIG. 5 is a side view of the ornament piece.

As shown in FIGS. 3–5, the ornamental piece 22 is generally disc-shaped and includes the first display surface 12 on one side and the second display surface 14 on the opposite side. A pair of pin members 24 extend from opposite front and rear sides of the ornamental piece 22. The pin members 24 are aligned along a central axis about which the ornamental piece 22 is rotatable as will be described further below.

The opposite left and right sides of the ornamental piece 22 each include a bar-shaped locking projection 26 extending therefrom. The locking projections 26 are provided for locking the ornament piece 22 in one of the two display positions as will also be described further below.

Figure 6:
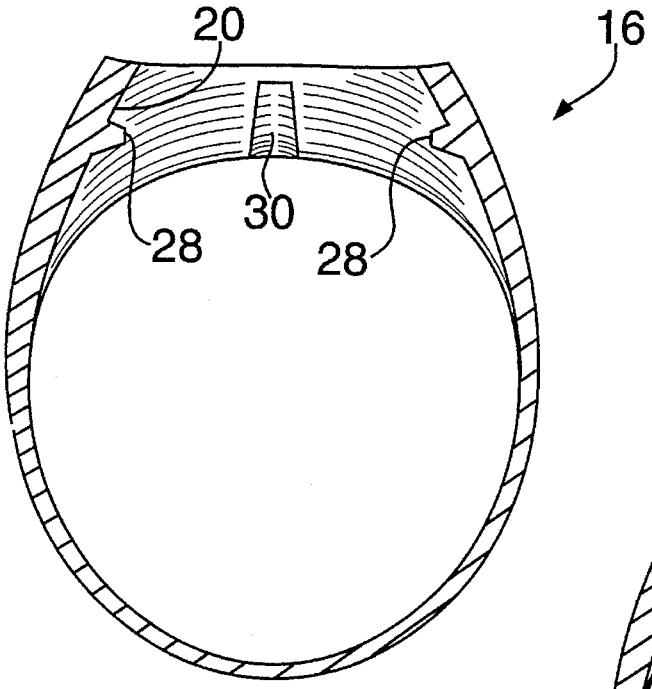
FIG. 6 is a front cross-section view of the body portion of the ring.

As shown in FIG. 6, the upper portion of the ring body 16 includes two tapered platform members 28 facing each other and projecting from the left and right sides of the ring body toward the center of the opening 20. The ring body 16 also includes two tapered vertical slots 30, each in opposite front and rear sides of the ring body 16. The slots 30 each include a closed upper end and an open lower end.

To assemble the ring 10, the ornament piece 22 is mounted in the opening 20 of the ring body 16 such that the pins 24 of the ornament piece 22 are each located in one of the tapered slots 30. The ornament piece 22 is thus (when in an unlocked position as will be described further below) free to slide along the length of the slots and to rotate therein. The lower open ends of the tapered slots 30 are then filled by soldering to prevent movement of the pins 24 out of the slots 30.

Figure 7:
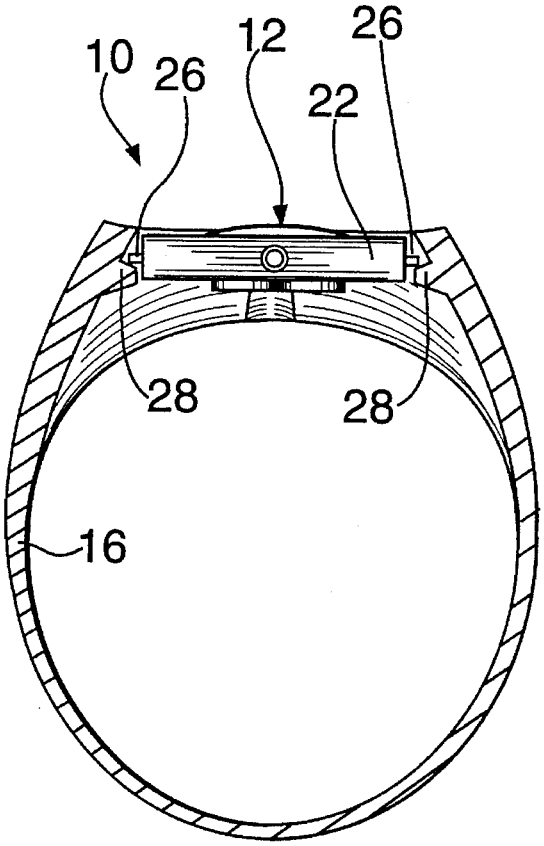
FIG. 7 is a partial cross-section view of the ring with the ornament piece being positioned in a first display position.

In FIG. 7, the ornament piece 22 is shown in a first display position wherein the first display surface 12 is displayed through the opening 20 of the ring body 16. (This position of the ornament piece is also shown in FIG. 1.) In this position, the locking projections 26 of the ornament piece 22 are engaged by and retained above the platform members 28 of the ring body 16. Also, the pins 24 of the ornament piece 22 are at the upper closed ends of the slots 30 of the ring body. The ornament piece 22 is thereby restrained from rotational or sliding movement with respect to the ring body 16.

Figure 8:
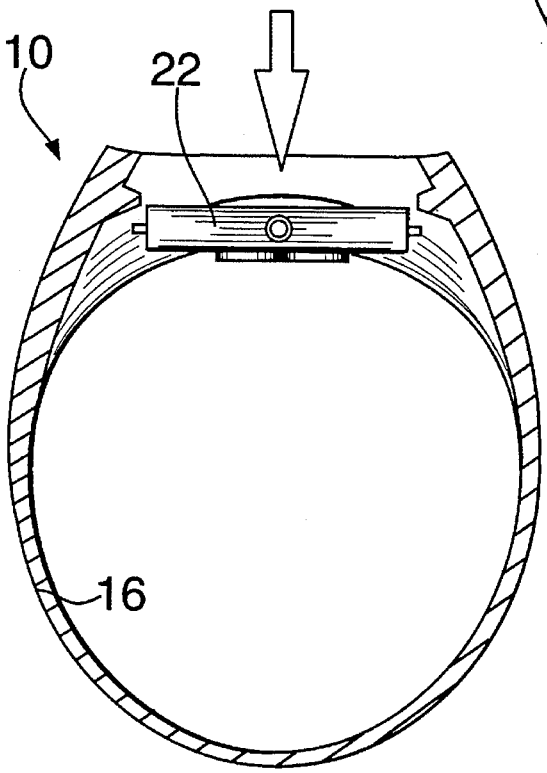
FIG. 8 is a partial cross-section view of the ring with the ornament piece in an unlocked position.
Figure 9:
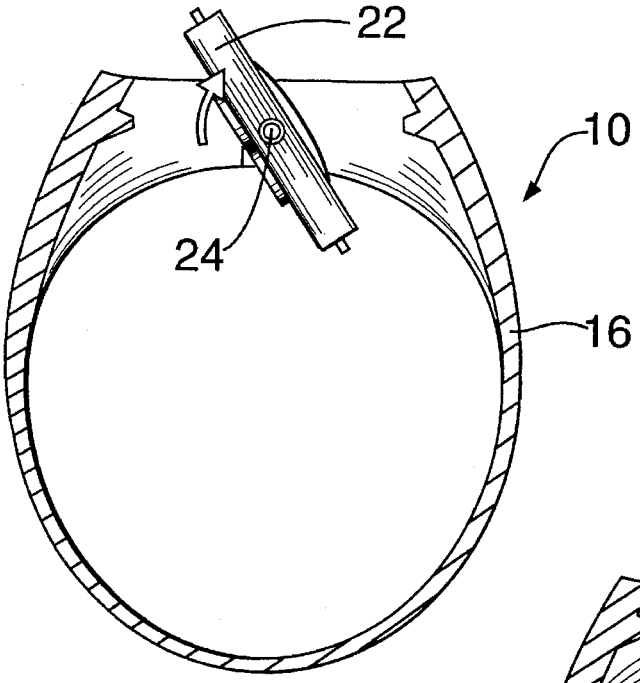
FIG. 9 is a partial cross-section view of the ring illustrating the rotation of the ornament piece with respect to the body portion.
Figure 10:
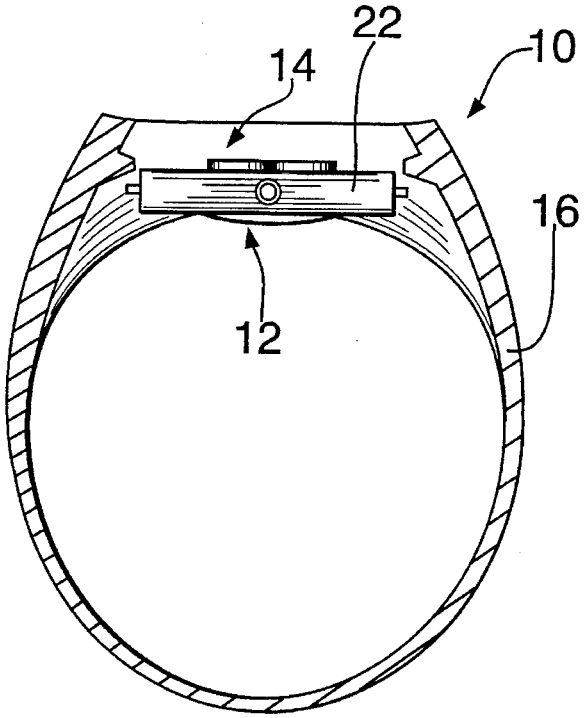
FIG. 10 is a partial cross-section view of the ring illustrating the ornament piece in a further unlocked position.
Figure 11:
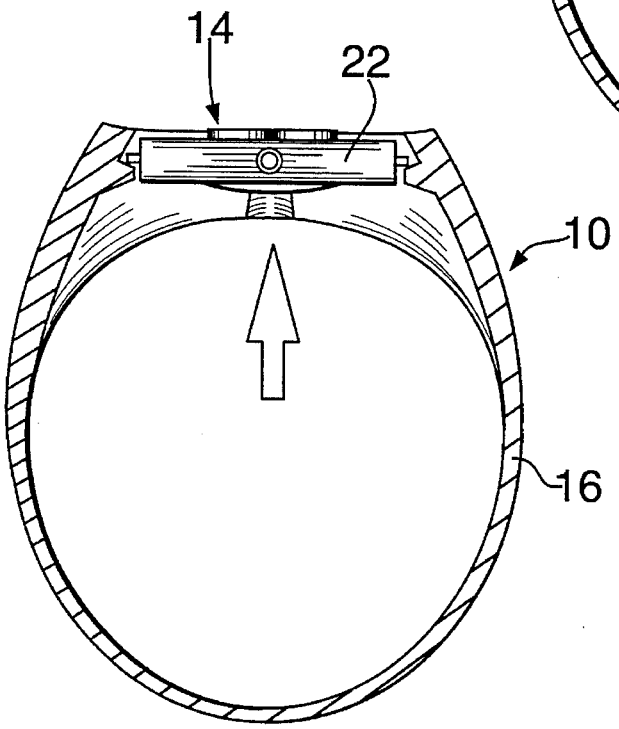
FIG. 11 is a partial cross-section view of the ring with the ornament piece positioned in a second display position.

To change the display surface of the ornament piece 22 shown through the opening 20, the ornament piece 22 must first be unlocked and moved to the position shown in FIG. 8. This can be accomplished by pressing down onto the ornament piece 22 such that either the platforms 28 or the locking projections 26 are resiliently deformed, enabling the locking projections 26 to become disengaged from and to clear the platforms 28. The pins 24 in the ornament piece 22 are retained in the vertical slots 30 and freely move downwardly in the slots 30. In the unlocked position shown in FIG. 8, the locking projections 26 are sufficiently spaced-apart from the platforms 28 such that the ornament piece 22 is free to rotate about the axis of the pin members 24. As shown in FIG. 9, the ornament piece 22 can thereby be rotated (by pressing down on one side thereof) to a further unlocked position shown in FIG. 10 where the second display surface 14 is now directly above the first display surface 12. To lock the ornament piece 22 in this second display position, it is pressed in an upward direction in the direction of the arrow in FIG. 11 such that the locking projections 26 on the ornament piece 22 again clear the platforms 28 and are thereby restrained further axial or rotational movement. The second display surface 14 is now displayed through the opening 20 in the ring body 16. (The FIG. 11 display position is also shown in FIG. 2.)

Thus, the ornamentation of the ring 10 can be quickly and easily changed when desired.

It should be noted that while a ring is used to illustrate the present invention, various other articles of jewelry such as, for example, pendants and earrings can be provided with changeable ornamentation in accordance with the present invention.

The present invention has been described in the foregoing specification with respect to specific embodiments. These embodiments serve as examples to illustrate the invention rather than to limit its scope. Modifications may be made thereto without departing from the broader teachings of the invention.

I claim:

1. An item of jewelry with changeable ornamentation, comprising:

a body portion including an opening therein, two vertical slots at opposite sides of said opening, and two platform members; and an ornament piece having a plurality of display surfaces including a first display surface on one side thereof and a second display surface on another side thereof, said ornament piece being rotatably mounted in said body portion such that said ornament piece is rotatable between a first display position in which said first display surface is displayed through said opening in said body portion and a second display position in which said second display surface is displayed through said opening in said body portion, said ornament piece including two pins extending from opposite sides thereof defining an axis about which said ornament piece is rotatable, said pins being rotatably and slidably mounted in said slots of said body portion, wherein said ornament piece includes two locking projections extending therefrom adapted to engage said platform members of said body portion to releasably lock said ornament piece in one of said first and second display positions and thereby restrain said ornament piece from movement with respect to said body portion, and wherein said locking projections or said platform members or both are resiliently deformable such that said locking projections can be forced out of engagement with said platform members to free said ornament piece for sliding movement with respect to said body portion such that said ornament piece can be slidably moved away from said opening to enable said platform members and said projections to be sufficiently spaced from each other to enable generally free rotation of said ornament piece to change display positions.

2. The item of jewelry of claim 1, wherein said platform members each include tapered upper and lower surfaces.

3. The item of jewelry of claim 1, wherein said body portion comprises a ring body including a finger throughole for receiving a finger of a wearer.

4. A method of changing ornamentation on an item of jewelry, said item of jewelry comprising a body portion and an ornament piece, said body portion having an opening therein, two vertical slots at opposite sides of said opening and two platforms, and said ornament piece having a plurality of display surfaces including a first display surface on one side thereof and a second display surface on another side thereof, said ornament piece also including two pins extending from opposite sides thereof defining an axis about which said ornament piece is rotatable, said pins being rotatably and slidably mounted in said slots of said body portion, said ornament piece further including two locking projections extending therefrom adapted to engage said platforms of said body portion to releasably lock said ornament piece and restrain said ornament piece from movement with respect to said body portion, said method comprising the steps of:

unlocking the ornament piece from a first display position in which said first display surface is displayed through said opening of said body portion and said ornament piece is restrained from movement with respect to the body portion, to thereby free the ornament piece for rotational movement with respect to the body portion, wherein said step of unlocking said ornament piece comprises pressing said ornament piece to resiliently deform said locking projections or said platforms or both to disengage said projections from said platforms and to push said ornament piece away from said opening in said body portion such that said pins of said ornament piece slide along said slots of said body portion until said locking projections and said platforms are sufficiently spaced to permit substantially free rotation of said ornament piece;

rotating said ornament piece until said second display surface is displayed through said opening in said body portion; and locking said ornament piece in a second display position in which said second display surface is displayed through said opening and said ornament piece is restrained from movement with respect to the body portion, wherein said step of locking said ornament piece comprises pushing said ornament piece toward the opening in the body portion such that the pins of said ornament piece slide along said slots of said body portion and said platforms and said locking projections are thereafter engaged such that said ornament piece is restrained from movement with respect to the body portion.

5. An item of jewelry with changeable ornamentation, comprising:

a body portion including an opening therein;

an ornament piece having a plurality of display surfaces including a first display surface on one side thereof and a second display surface on another side thereof;

means for movably mounting said ornament piece in said body portion such that said ornament piece is movable between a first display position in which said first display surface is displayed through said opening in said body portion and a second display position in which said second display surface is displayed through said opening in said body portion, wherein said means for movably mounting said ornament piece comprise two pins extending from opposite sides of the ornament piece defining an axis about which said ornament piece is rotatable, and two vertical slots at opposite sides of said opening in said body portion, said slots being adapted to receive said pins for rotating and sliding movement of said pins therein; and means for releasably locking said ornament piece in each of said first and second display positions comprising two locking projections extending from said ornament piece, and two platforms extending from said body portion adapted to engage said locking projections to releasably lock said ornament piece in one of said first and second display positions, wherein said ornament piece can be unlocked from said display positions and slidably moved away from said opening by sliding said pins along said slots to enable said projections and said platforms to be sufficiently spaced to permit generally free rotation of said ornament piece.

6. The item of jewelry of claim 5, wherein said body portion comprises a ring body including a finger throughole for receiving a finger of a wearer.

* * * * *